US006422617B1

(12) United States Patent
Fukumoto et al.

(10) Patent No.: US 6,422,617 B1
(45) Date of Patent: Jul. 23, 2002

(54) DOOR LOCK DEVICE FOR MOTOR VEHICLES

(75) Inventors: Ryoichi Fukumoto, Nagoya; Masao Ohhashi, Kariya; Katsuhisa Yamada; Takashi Saitoh, both of Toyota; Katsuyuki Ohtake, Yokosuka; Katsuhiro Suzuki, Nisshin, all of (JP)

(73) Assignees: Aisin Seiki Kabushiki Kaisha, Kariya; Kanto Jidosha Kogyo Kabushiki Kaisha, Yokosuka, both of (JP)

( * ) Notice: Subject to any disclaimer, the term of this patent is extended or adjusted under 35 U.S.C. 154(b) by 0 days.

(21) Appl. No.: 09/632,268

(22) Filed: Aug. 3, 2000

(30) Foreign Application Priority Data

Aug. 9, 1999 (JP) ..... 11-224988

(51) Int. Cl.[7] ..... E05C 3/06; E05C 3/16
(52) U.S. Cl. ..... 292/216; 292/201; 292/DIG. 23
(58) Field of Search ..... 292/216, DIG. 23, 292/201

(56) References Cited

U.S. PATENT DOCUMENTS 4,976,478 A * 12/1990 Acciacca et al. ..... 292/201
5,564,761 A * 10/1996 Mizuki et al. ..... 292/201
5,618,068 A * 4/1997 Mitsui et al. ..... 292/201
5,639,130 A * 6/1997 Rogers, Jr. et al. ..... 292/216
5,802,894 A * 9/1998 Jahrsetz et al. ..... 70/264
5,938,252 A * 8/1999 Uenura et al. ..... 292/201

FOREIGN PATENT DOCUMENTS

| | | |
|---|---|---|
| JP | 2-96079 | 4/1990 |
| JP | 6-50045 | 2/1994 |
| JP | 2816804 | 8/1998 |

* cited by examiner

*Primary Examiner*—Lynne Browne
*Assistant Examiner*—John B. Walsh
(74) *Attorney, Agent, or Firm*—Burns, Doane, Swecker & Mathis, LLP

(57) ABSTRACT

In a door closer device which requires at least three switches consisting of a half door detection switch, a full lock (completely closing) detection switch and a switch for detecting the return to the initial position, the number of switches can be reduced. Two cam switch operating portions are formed on a cam plate fixedly secured to an output shaft of a motor. The motor is stopped by making use of one operating portion and the motor is rotated in a reverse direction by making use of the other operating portion.

7 Claims, 8 Drawing Sheets

DOOR LOCK DEVICE FOR MOTOR VEHICLES

BACKGROUND OF THE INVENTION

This invention relates to a door lock device for motor vehicles which can automatically operate a door in an incompletely closed (half-latch) position to a completely closed (full-latch) position.

The completely closed (full-latch) condition of a door of a vehicle can be obtained by engaging a striker which constitutes a body-side member of the vehicle with a latch which constitutes a portion of a door lock device provided on a back door or a side door. As shown in FIG. 8, the latch 1 is disposed rotatably about a pin 2 and is always forcibly directed in one direction by receiving a biasing force of a spring 3. The latch 1 includes an engaging groove 5 which receives a striker 4, a first pawl receiving portion 6 which is formed on the periphery of the latch 1 and establishes the door completely closed (full-latch) condition, and a second pawl receiving portion 7 which establishes the door incompletely closed (half-latch) condition. A protrusion 9 of a pawl 8 is engageable with one of both the pawl portions 6, 7.

The pawl 8 is rotatable about a pin 9' which works as the center of rotation and the pawl 8 is always forcibly rotated in a direction toward the latch 1 by means of a spring 10. The pawl 8 is movable in the counter-clockwise direction corresponding to the movement of a pin 11 of a lift lever which belongs to an open system of a door lock device.

In the door opened condition or position, the engaging groove 5 is rotated in the right direction as seen in FIG. 8 and the protrusion 9 of the pawl 8 comes into contact with an outer peripheral surface 12 of the latch 1. Upon the door closing manipulation, the striker 4 enters the inside of the engaging groove 5 and forcibly rotates the latch 1 in the counter-clockwise direction and hence, the protrusion 9 is engaged with the second pawl receiving portion 7 to establish the incompletely closed (half-latch) condition, that is, the incompletely latched condition of the door. Upon the further door closing manipulation, the protrusion 9 is engaged with the first pawl receiving portion 6 so as to establish the completely closed (full-latch) condition, that is, the completely latched condition (condition shown in FIG. 8).

In the above-mentioned door closing manipulation, when the manipulation force is weak or the like, a case that the door closing manipulation ends with the protrusion 9 of the pawl 8 held in the incompletely closed condition in which the protrusion 9 of the pawl 8 is engaged with the second pawl receiving portion 7 may arise. Then, the door in the incompletely closed (half-latch) condition is automatically shifted to the completely closed (full-latch) condition by means of a door closer mechanism.

Examples of this type of door closer are disclosed in Japanese Patent Laid-Open Publication No. 96079/1990, Japanese Patent Laid-Open Publication No. 50045/1994 or Japanese Patent Publication No. 2816804/1999.

In the conventional door closer device, at least three switches consisting of a half-latch detection switch, an overlock (full-latch) detection switch and an initial position detection switch are arranged. In response to signals outputted from these switches, manipulations consisting of the start of pulling operation, the start of reverse operation to return a passive lever to the initial position, and the completion of the operation due to the detection of returning of the passive lever to the initial position and the stop of a motor are carried out.

However, the preparation and the mounting of three switches bring about drawbacks that the assembling operation becomes difficult and the device becomes large-sized.

SUMMARY OF THE INVENTION

Accordingly, it is an object of the present invention to provide a door lock device which can overcome the drawbacks of the above-mentioned prior art.

To overcome the above-mentioned drawbacks, the present invention adopts basic technical steps that a cam plate having a pair of signal generating portions is mounted on a motor output shaft and a cam switch having a contact member which comes into contact with each of these signal generating portions is combined with the cam plate.

To be more specific, the present invention provides a door lock device which includes a bracket which has a fixed relationship relative to a door panel, a door lock which includes a latch, a pawl and a latch lever which is fixedly secured to a rotary shaft of the latch, a passive lever which is rotatably supported relative to the bracket and includes a free end portion which is capable of coming into contact with the latch lever, a drive source which is retained by the bracket and mounts a cam plate on an output shaft thereof and is interlocked with the passive lever, a cam switch which has a contact member coming into contact with the cam plate and has a fixed relationship relative to the bracket, and a half latch switch which detects a door incompletely (half) latched condition of a latch which constitutes a door lock, wherein the cam plate includes a motor stop signal generating portion and a motor reverse rotation signal generating portion.

Upon the normal rotation of the motor, the passive lever is rotated by way of the cam plate to establish the door completely (fully) latched condition and simultaneously the signal generating portion of the cam plate outputs a signal to make the motor rotated in the reverse direction so as to return the passive lever to the initial position. Accordingly, two signals are outputted with one cam plate so that at least one switch can be eliminated.

These and other objects and advantages of the present invention will become further apparent from the following detailed explanation.

DETAILED DESCRIPTION OF THE PREFERRED EMBODIMENTS

Embodiments of the present invention are explained hereinafter in conjunction with attached drawings.

Figure 1:
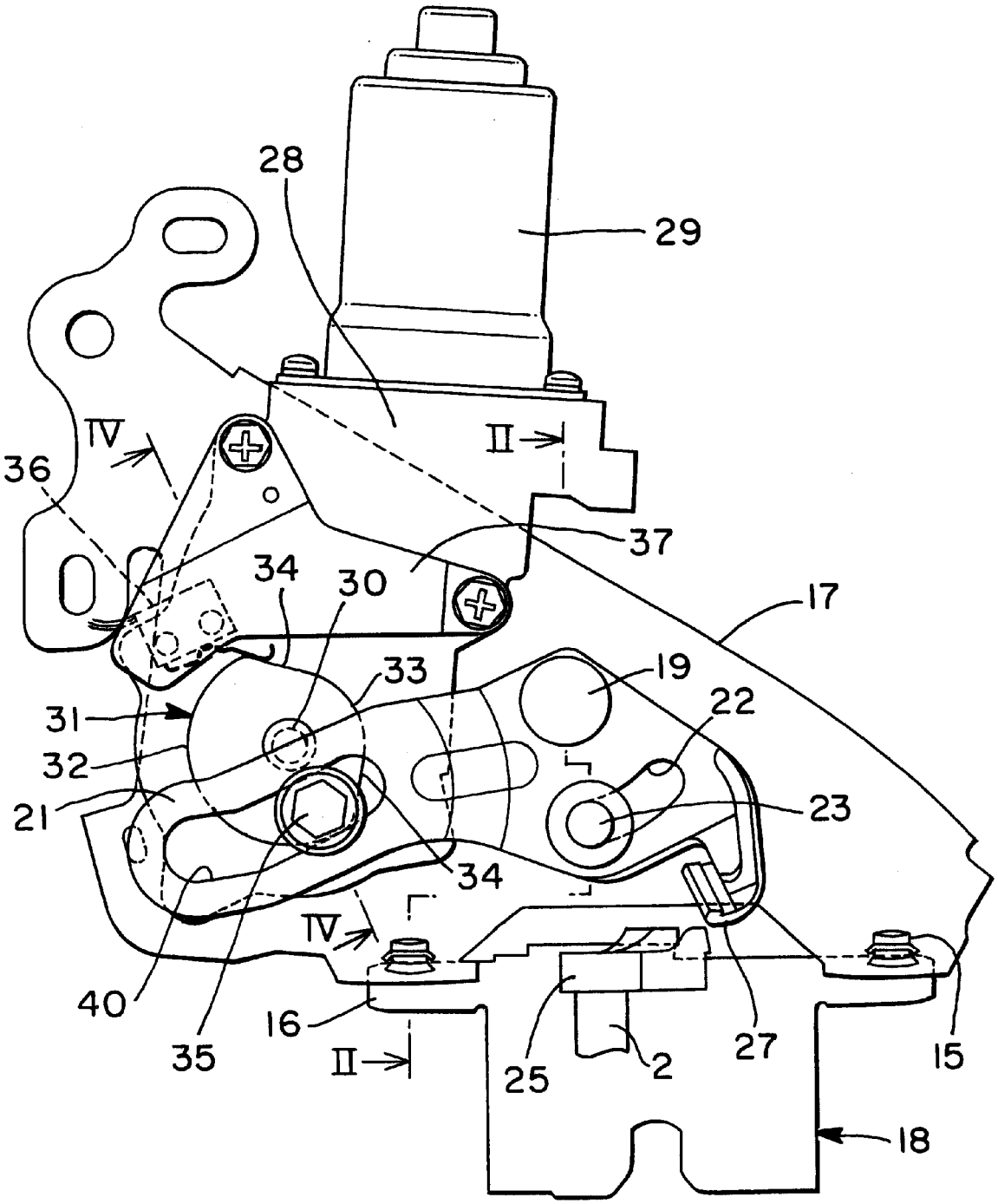
FIG. 1 is a front view of a door lock device of one embodiment of the present invention.
Figure 2:
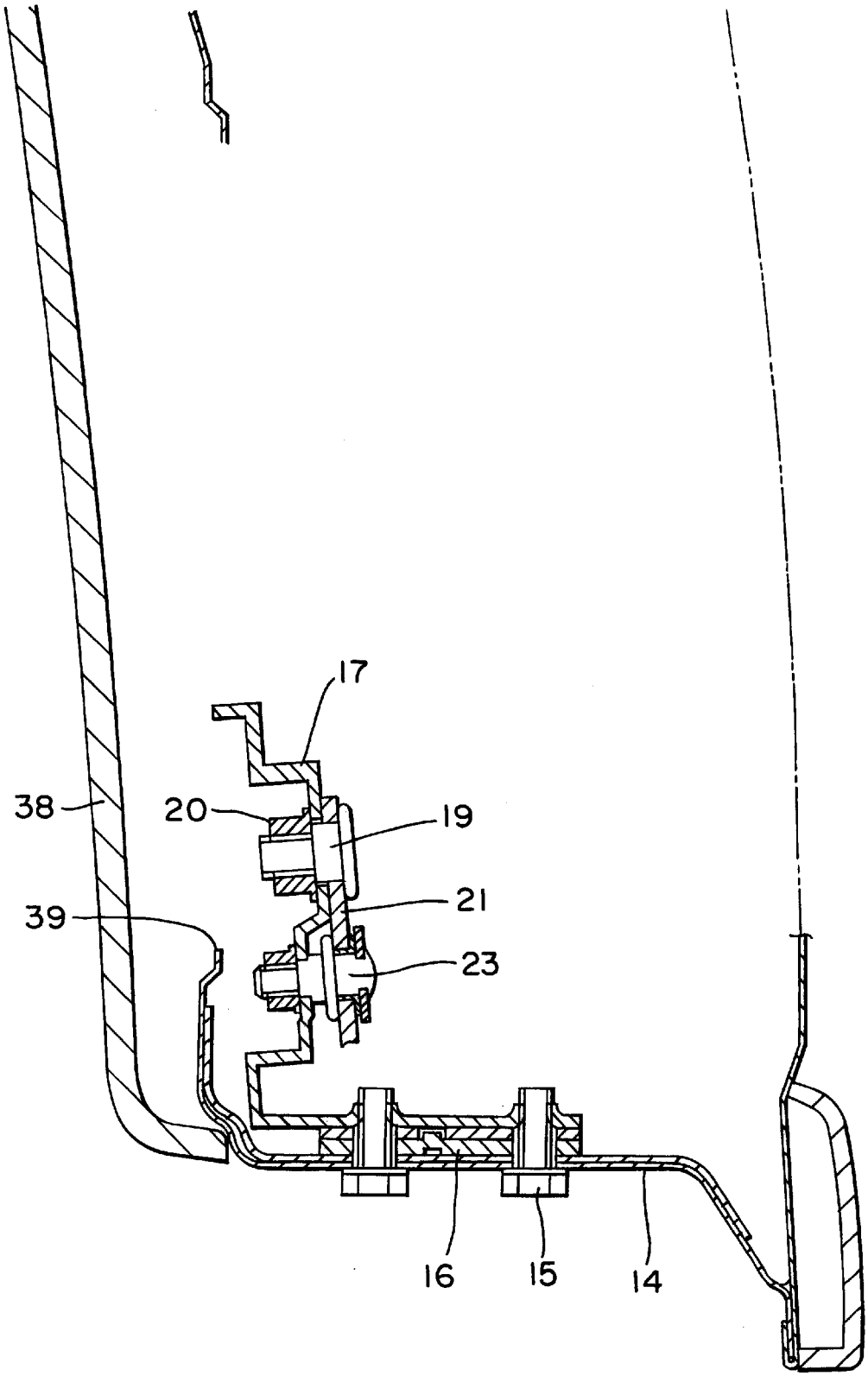
FIG. 2 is a cross-sectional view as taken along an arrow II—II of FIG. 1.

As shown in FIG. 1 and FIG. 2, a door closer device 13 includes a base plate 16 which is fixedly secured to a door inner panel 14 with the use of a bolt 15 and a motor bracket 17. A door lock 18 is supported on the base plate 16 and a passive lever 21 is rotatably supported on the motor bracket 17 having a shape which traces an indoor trim 38 with the use of a bolt 19 and a nut 20. The rotation of the passive lever 21 about the bolt 19 which works as the center of rotation is guided by a pin 23 which projects from the motor bracket 17 and passes through an elongated hole 22 formed in the passive lever 21.

Figure 3:
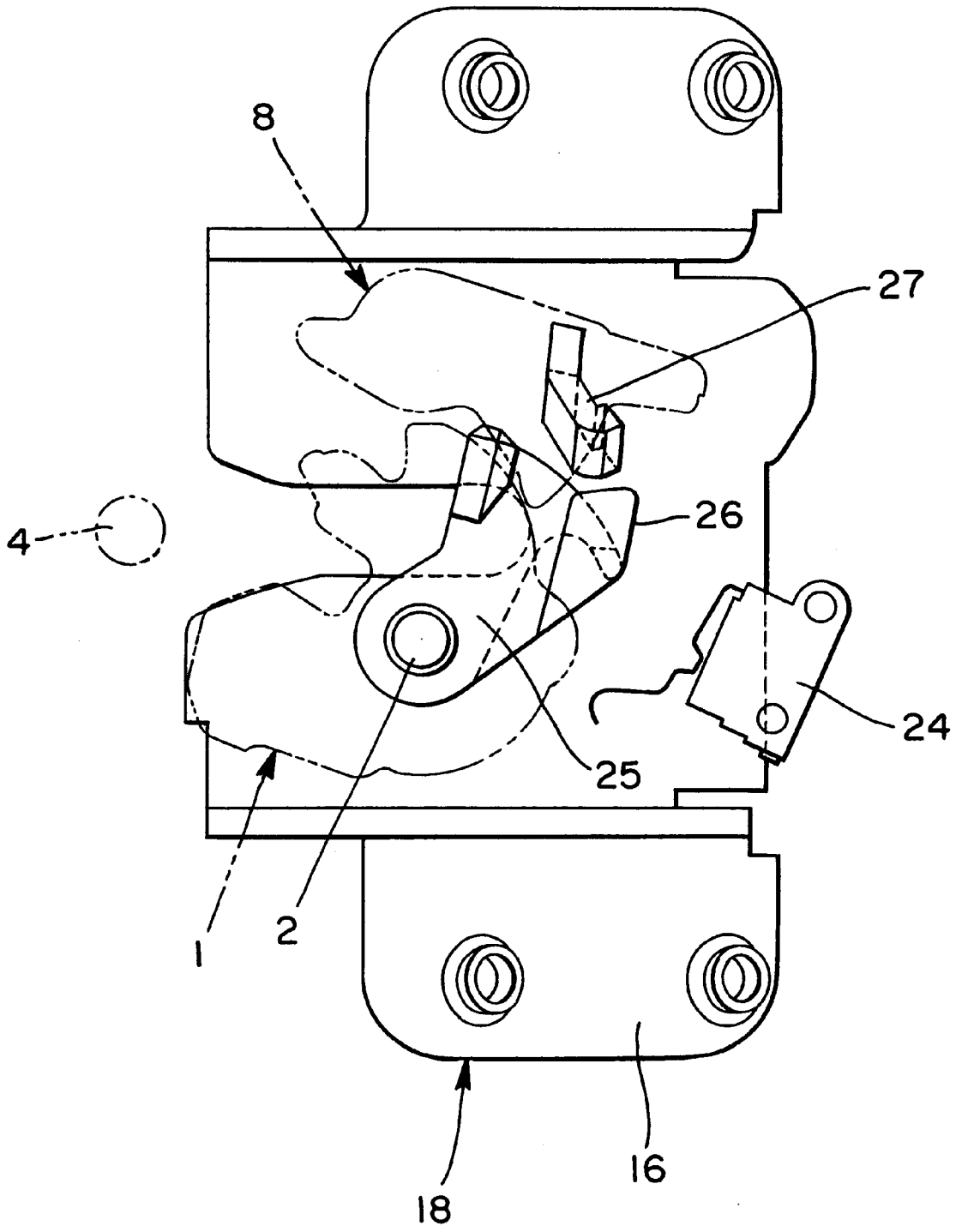
FIG. 3 is a plan view showing the door lock.
Figure 8:
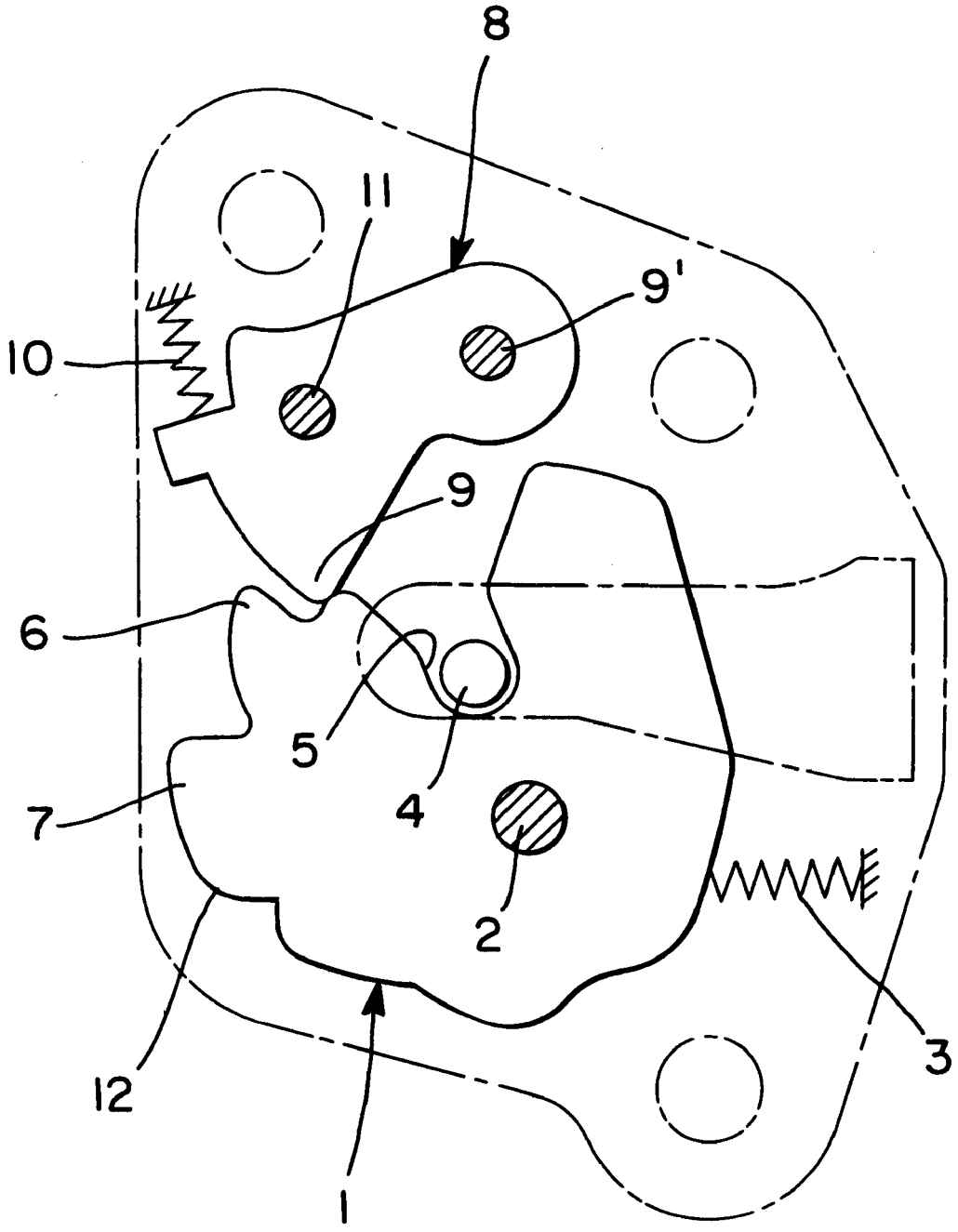
FIG. 8 is a plan view showing the movement of the latch and the pawl.

As shown in FIG. 3, the door lock 18 includes a latch 1 and a pawl 8 as its basic constitution (refer to FIG. 8). Although the door lock 18 has substantially the same constitution as that shown in FIG. 6, in addition to the constitution shown in FIG. 6, the door lock 18 includes a half latch switch 24. When the door becomes the incompletely (half) latched condition in which a protrusion 9 of the pawl 8 is engaged with a second pawl receiving portion 7 of the latch 1 upon the door closing operation, the half latch switch 24 outputs an electric signal which indicates that the door is in the incompletely (half) latched condition.

A latch lever 25 is fixedly secured to the pin 2 of the latch 1. The fan-shaped latch lever 25 has a proximal side one end thereof fixedly secured to the pin 2 and is provided with a protrusion 26 at a free end portion thereof.

A free end portion 27 formed on one end of the passive lever 21 is made to face the protrusion 26 of the latch lever 25 in an opposed manner.

As shown in FIG. 1, the passive lever 21 is made of a thin elongated plate and has an elongated slot 40 at a left side portion thereof. The passive lever 21 is rotatable about the bolt 19 which works as the center of rotation.

A motor 29 equipped with a speed reduction mechanism 28 is held by a motor bracket 17 which is supported on the door inner panel 14. A cam plate 31 is fixedly secured to an output shaft 30 of the speed reduction mechanism 28.

The cam plate 31 consists of a semicircular portion 32 which sets its center of rotation as the center of curvature, a small arcuate portion 33 which has the curvature smaller than the curvature of the semicircular portion 32 and is positioned at the opposite side relative to the semicircular portion 32, and a pair of straight portions 34 which connect terminal ends of the semicircular portion 32 and the small arcuate portion 33.

Figure 4:
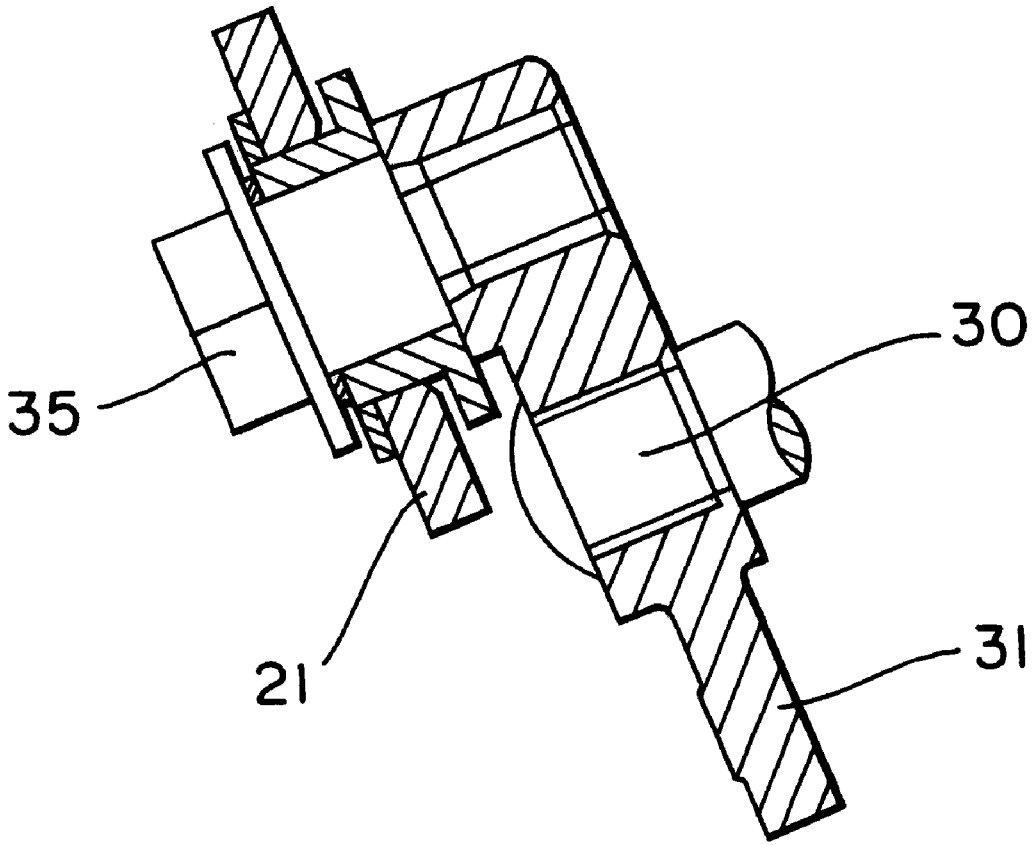
FIG. 4 is a cross-sectional view as taken along an arrow IV—IV of FIG. 1.

As shown in FIG. 4, a drive bolt 35 is screwed into one terminal end portion of the semicircular portion 32 of the cam plate 31 through the slot 40 formed in the passive lever 21.

A cam switch 36 having a contact point which comes into contact with the outer peripheral surface of the cam plate 31 is supported on a cam switch bracket 37. The cam switch bracket 37 is fixedly secured to the motor bracket 17 by screws. Upon receiving a signal from this cam switch 36, the motor 29 is rotated in the normal direction or in the reverse direction.

Figure 5:
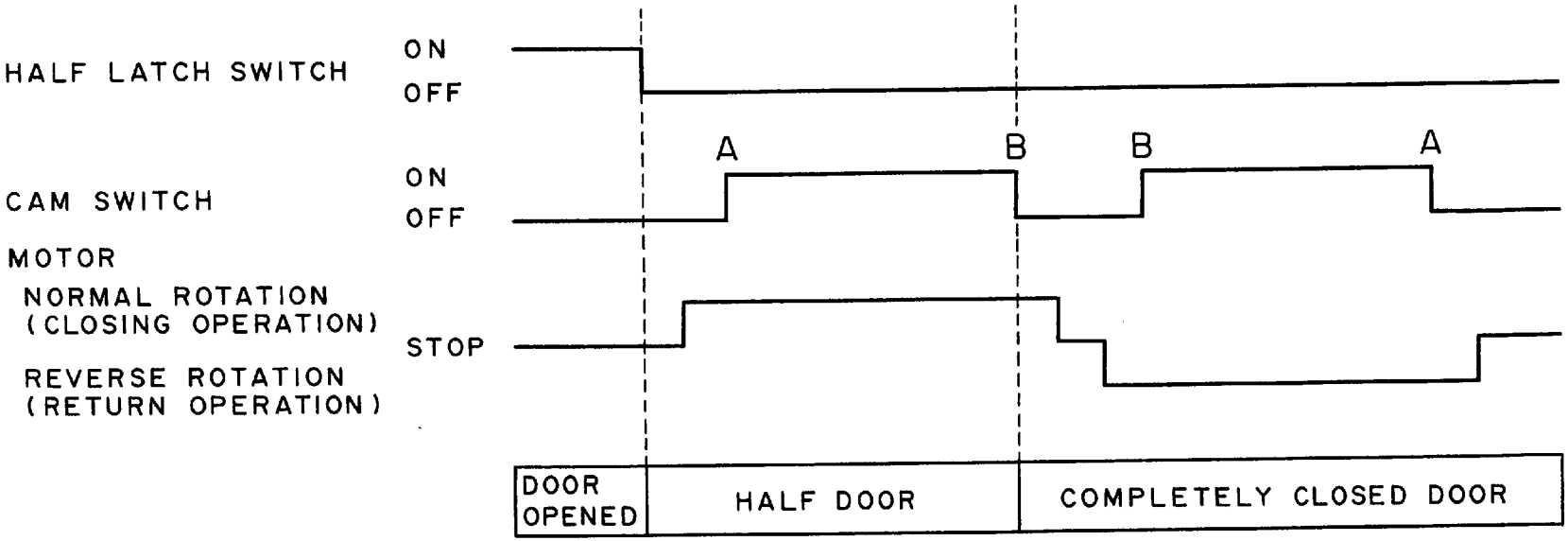
FIG. 5 is an operational view showing the movement of the motor and various switches in the door opened or closed conditions.

FIG. 5 shows the ON condition, the OFF condition, the normal rotation condition and the reverse rotation condition of the half latch switch 24, the cam switch 36 and the motor 29 when the door is opened, when the door is in the half door condition (in the incompletely (half) latched condition) and when the door is completely closed (in the completely (fully) latched condition).

During the door closing operation, when the half latch switch 24 (see FIG. 3) detects the incompletely (half) latched condition in which the pawl portion 9 of the pawl 8 is engaged with the second pawl receiving portion 7 of the latch (see FIG. 8), a detection signal is transmitted to the motor 29 so as to rotate the motor 29 in the normal direction. Here, as shown in FIG. 6, although the contact member of the cam switch 36 comes into contact with an A portion of the cam plate 31, due to the rotation of the motor 29 in the normal direction (clockwise direction as seen in FIG. 6), the contact member of the cam switch 36 comes into contact with the outer peripheral surface of the semicircular portion 32 of the cam plate 31 and maintains the rotation of the motor 29 in the normal direction.

Figure 6:
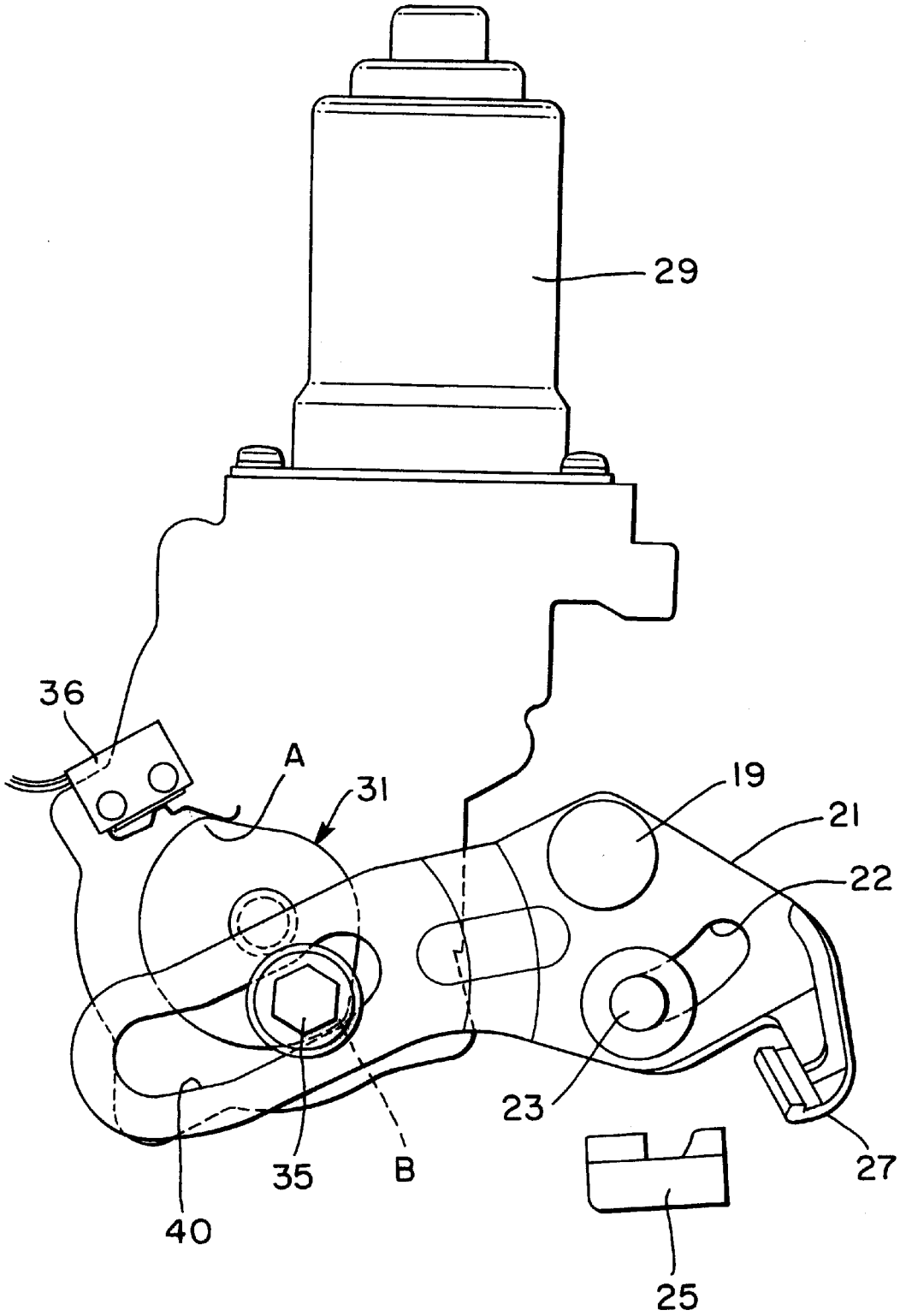
FIG. 6 is a front view showing the initial position of the passive lever.
Figure 7:
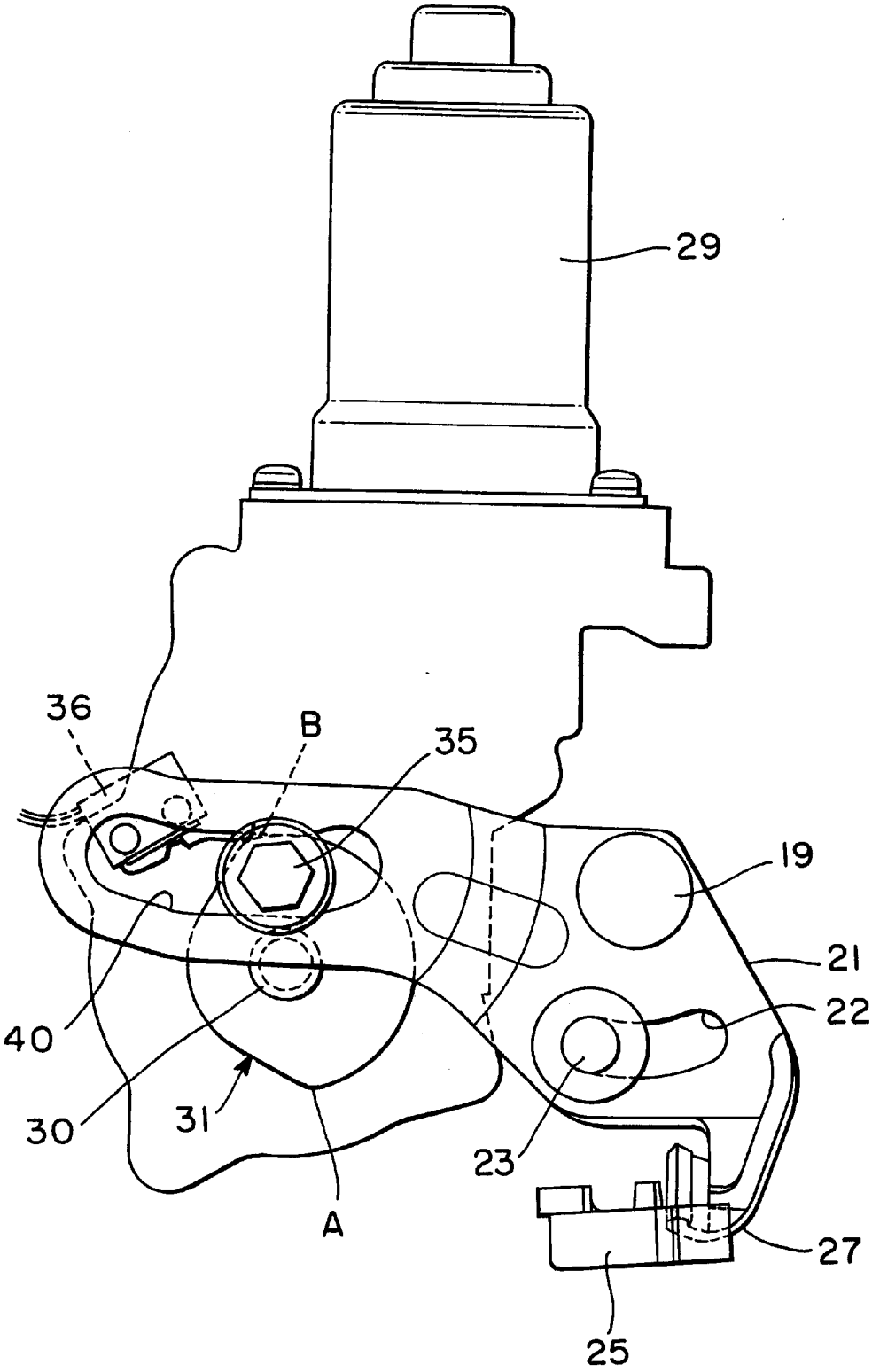
FIG. 7 is a front view showing the condition where the free end portion of the passive lever comes into contact with the latch lever.

The further rotation of the motor 29 in the normal direction brings the contact member of the cam switch 36 into contact with a B portion of the cam plate 31 as shown in FIG. 7. When the contact member comes into contact with the B portion (see FIG. 7), the cam switch 36 transmits a signal to the motor 29 so as to stop the motor 29 and to rotate the motor 29 in the reverse direction. The rotation of the motor 29 in the reverse direction soon brings the above-mentioned contact member into contact with the A portion of the cam plate 31. Due to this contact, the cam switch 36 outputs a motor stop signal so as to stop the motor 29. That is, the motor 29 returns to the initial position and maintains the initial position shown in FIG. 6 until the motor 29 receives a signal from the half latch switch 24.

As shown in FIG. 6 and FIG. 7, the rotation of the motor 29 in the normal direction rotates the passive lever 21 in the clockwise direction about the bolt 19 which works as the center of rotation. This movement is produced as the bolt 35 moves in and along the slot 40 corresponding to the rotation of the cam plate 31.

At the point of time that the contact member of the cam switch 36 comes into contact with the B portion of the cam plate 31, the free end portion 27 of the passive lever 21 pushes the latch lever 25 so as to establish the completely (fully) closed condition, that is, the completely (fully) latched condition of the door. After establishing this completely (fully) latched condition, corresponding to the rotation of the motor 29 in the reverse direction, the passive lever 21 returns to the initial position (see FIG. 6) where the free end portion 27 of the passive lever 21 is moved away from the latch lever 25.

The contacting of the contact member of the cam switch 36 to the A portion of the cam plate 31 makes the cam switch 36 output the signal to stop the motor 29 and the contacting of the contact member of the cam switch 36 to the B portion of the cam plate 31 makes the cam switch 36 output the signal to rotate the motor 29 in the reverse direction.

This makes it possible to perform the following controls. That is, for example, when the malfunction occurs in the midst of the movement from A to B of the cam switch of FIG. 5, the control is performed such that the motor 29 is rotated in the reverse direction upon receiving the signal corresponding to the B portion to return the cam switch to the A portion and then the motor 29 is stopped, while when the malfunction occurs in the midst of the movement from B to A of the cam switch of FIG. 5, the control is performed such that the motor 29 continues its operation to obtain a motor stop signal which is outputted when the A portion comes into contact with the contact member of the cam switch 36.

As many apparently widely different embodiments of the present invention can be made without departing from the spirit and scope thereof, it is to be understood that the invention is not limited to the specific embodiments thereof except as defined in the appended claims.

What is claimed is:

1. A door lock device for a motor vehicle comprising:

a bracket adapted to make a fixed relationship relative to a door panel, a door lock means which includes a latch, a pawl and a latch lever which is fixedly secured to a rotary shaft of the latch, a passive lever which is rotatably supported relative to the bracket and includes a free end portion which,is capable of coming into contact with the latch lever, a drive source held by the bracket, a cam plate mounted on an output shaft of the drive source and interlocked with the passive lever, a cam switch which has a contact member coming into contact with the cam plate and has a fixed relationship relative to the bracket, and a half latch switch which detects a door half latched condition of the latch which constitutes the door lock device, wherein the cam plate includes a motor stop signal generating portion and a motor reverse rotation signal generating portion, the cam plate having a semicircular portion and a small-diameter portion which approaches the center of curvature of the semicircular portion from terminal ends of the semicircular portion, and the signal generating portions being formed on one terminal end and the other terminal end.

2. A door lock device according to claim 1, wherein when the passive lever takes an initial position, the contact member of the cam switch comes into contact with the motor stop signal generating portion, and when the free end portion of the passive lever approaches the latch lever to establish the door fully latched condition, the contact member of the cam switch comes into contact with the motor reverse rotation signal generating portion.

3. A door lock device according to claim 1, wherein the passive lever includes an elongated guide hole which receives a pin projecting from the bracket.

4. A door lock device for a motor vehicle comprising:

a bracket adapted to make a fixed relationship relative to a door panel, a door lock means which includes a latch, a pawl and a latch lever which is fixedly secured to a rotary shaft of the latch, a passive lever which is rotatably supported relative to the bracket and includes a free end portion which is capable of coming into contact with the latch lever, a drive source held by the bracket, a cam plate mounted on an output shaft of the drive source and interlocked with the passive lever, a cam switch which has a contact member coming into contact with the cam plate and has a fixed relationship relative to the bracket, and a half latch switch which detects a door half latched condition of the latch which constitutes the door lock device, wherein the cam plate includes a motor stop signal generating portion and a motor reverse rotation signal generating portion, the cam plate including an operating shaft which projects from the cam plate and passes through an elongated slot of the passive lever.

5. A door lock device for a motor vehicle comprising:

a bracket adapted to make a fixed relationship relative to a door panel, a door lock means which includes a latch, a pawl and a latch lever which is fixedly secured to a rotary shaft of the latch, a passive lever which is rotatably supported relative to the bracket and includes a free end portion which is capable of coming into contact with the latch lever, a drive source held by the bracket, a cam plate mounted on an output shaft of the drive source and interlocked with the passive lever, a cam switch which has a contact member coming into contact with the cam plate and has a fixed relationship relative to the bracket, and a half latch switch which detects a door half latched condition of the latch which constitutes the door lock device, wherein the cam plate includes a motor stop signal generating portion and a motor reverse rotation signal generating portion, the cam plate having a semicircular portion and a small-diameter portion which approaches the center of curvature of the semicircular portion from terminal ends of the semicircular portion, and the signal generating portions being formed on one terminal end and the other terminal end, wherein when the passive lever takes an initial position, the contact member of the cam switch comes into contact with the motor stop signal generating portion, and when the free end portion of the passive lever approaches the latch lever to establish the door fully latched condition, the contact member of the cam switch comes into contact with the motor reverse rotation signal generating portion.

6. A door lock device for a motor vehicle comprising a passive lever rotatably supported on a bracket adapted to a member of a door panel of a door and having a guide hole which receives a pin projecting from the bracket and a slot which receives an operating shaft projecting from a cam plate, a cam switch cooperating with the cam plate to provide a signal for operating an electric motor, and a latch lever to establish a door lock condition and located to oppose a part of the passive lever, and a half latch switch for supplying a motor operation signal when a half-latch position of the door is detected, wherein the rotation of the electric motor is transmitted through the cam plate and the operating shaft to the passive lever which operates the latch lever to make a full-latch positions of the door.

7. A door lock device according to claim 6, wherein when the passive lever takes an initial position, a contact member of the cam switch comes into contact with a motor stop signal generating portion of the cam plate, and when the free end portion of the passive lever approaches a latch lever to establish the door fully latched condition, the contact member of the cam switch comes into contact with a motor reverse rotation signal generating portion of the cam plate.

* * * * *